United States Patent [19]

Negishi et al.

[11] Patent Number: 4,831,837

[45] Date of Patent: May 23, 1989

[54] TRANSPORTING SYSTEM FOR REFRIGERATED MERCHANDISE

[75] Inventors: Kozaburo Negishi, Isesaki; Riichi Sakano, Okabe; Mamoru Sunaga, Ota; Susumu Ikeda; Shinji Matsubayashi, both of Isesaki, all of Japan

[73] Assignee: Sanden Corporation, Gunma, Japan

[21] Appl. No.: 141,191

[22] Filed: Jan. 6, 1988

[30] Foreign Application Priority Data

| | | | |
|---|---|---|---|
| Jan. 8, 1987 | [JP] | Japan | 62-2092 |
| Jan. 8, 1987 | [JP] | Japan | 62-2093 |
| Mar. 3, 1987 | [JP] | Japan | 62-29913[U] |

[51] Int. Cl.[4] ..... B60H 1/32

[52] U.S. Cl. ..... 62/239; 62/332

[58] Field of Search ..... 62/180, 299, 332, 409, 62/239

[56] References Cited

U.S. PATENT DOCUMENTS

| | | | |
|---|---|---|---|
| 2,862,369 | 12/1958 | Simons | 62/89 |
| 4,147,038 | 4/1979 | Hoebing et al. | 62/180 |
| 4,175,401 | 4/1979 | McManus | 62/180 |
| 4,245,481 | 1/1981 | McDermott | 62/180 X |
| 4,362,091 | 12/1982 | Cox | 62/299 X |
| 4,459,819 | 7/1984 | Hargraves | 62/212 |
| 4,483,151 | 11/1984 | Fujioka et al. | 62/157 |
| 4,619,114 | 10/1986 | Wilson | 62/332 X |
| 4,633,677 | 1/1987 | Maehara | 62/256 |
| 4,637,220 | 1/1987 | Sakano | 62/200 |
| 4,676,073 | 6/1987 | Lawrence | 62/180 |

OTHER PUBLICATIONS

U.S. Appln. Ser. No. 061,474, S. Ikida, Jun. 15, 1987.

U.S. Appln. Ser. No. 142,710, I. Kato and M. Sunaga, Jan. 11, 1988.

U.S. Appln. Entitled "Refrigerator With Variable Volume Independently Cooled Storage Chambers", K. Negishi, May 31, 1988.

*Primary Examiner*—William E. Tapolcai

*Attorney, Agent, or Firm*—Banner, Birch, McKie & Beckett

[57] ABSTRACT

A container for use in transporting refrigerated and/or frozen merchandise by transporting vehicle or the like together with other normal parcels and packages comprising an insulated container in which the refrigerated/frozen merchandise is stored and which is designed to be loaded onto and to be unloaded from the transporting vehicle or the like, and two refrigerating units for refrigerating the interior space thereof while at a warehouse or other facility and while carried on the transporting vehicle or the like. One of the refrigerating units is assembled on the transporting vehicle or the like and connectable with the container for the circulation of air between the container and the refrigerating unit. The other refrigerating unit is disposed on the container and operated by commercial electric power.

11 Claims, 8 Drawing Sheets

TRANSPORTING SYSTEM FOR REFRIGERATED MERCHANDISE

BACKGROUND OF THE INVENTION

This invention relates to a transporting system for carrying refrigerated and/or frozen merchandise together with normal parcels and packages, and more particularly, to a refrigerated container for use in such a system.

In general, merchandise, parcels and packages are transported from one place to another by vehicles after being gathered at a collecting station. Refrigerated/-frozen merchandise that is collected in such a system must be shipped in refrigerated containers and, while awaiting shipment for final delivery, must be stored under refrigeration to maintain its temperature.

Previous systems for transporting refrigerated/frozen merchandise required warehouses with refrigerating capability as well as vehicles with refrigerated containers. Thus, a relatively expensive system was required.

Recently, there has been an increase in the demand for the delivery of personal parcels or small packages to homes or offices. To handle refrigerated/frozen merchandise to be delivered, each shop and distribution center in the transportation system requires means such as a refrigerator or refrigerated space for storing the merchandise.

On the other hand, refrigerating apparatus used to refrigerate a warehouse and a container for the vehicle are specifically different and are not interchangeable. For example, refrigerating apparatus for a warehouse is normally operated by commerical electric power while refrigerating apparatus or a container for a vehicle is operated by the power available on the vehicle. Thus, in shipping refrigerated/frozen merchandise it must be moved from one refrigerating apparatus to another in moving in between the vehicle and the warehouse, which is expensive.

SUMMARY OF THE INVENTION

It is the primary object of this invention to provide a transportation system for refrigerated/frozen merchandise which does not require refrigerated warehouses for storing the merchandise. It is another object of this invention to provide a transportation system for refrigerated/frozen merchandise in which the merchandise can be transported in the same containers while maintaining the required temperature.

A transportation system for transporting refrigerated/frozen merchandise together with normal parcels in accordance with this invention comprises an insulated container in which the merchandise is stored and which is adapted to be moved between the vehicle and the warehouse or other storage or holding area, which container includes a first refrigerating unit for refrigerating an interior space of the container while the container is being held in the warehouse or similar facility, and a second refrigerating unit for refrigerating the interior space of the container while the container is carried on the transporting vehicle or the like.

Further objects, features, and other aspects of this invention will be understood from the following detailed description of the preferred embodiments of this invention referring to the attached drawings.

DETAILED DESCRIPTION OF THE PREFERRED EMBODIMENTS

Figure 1:
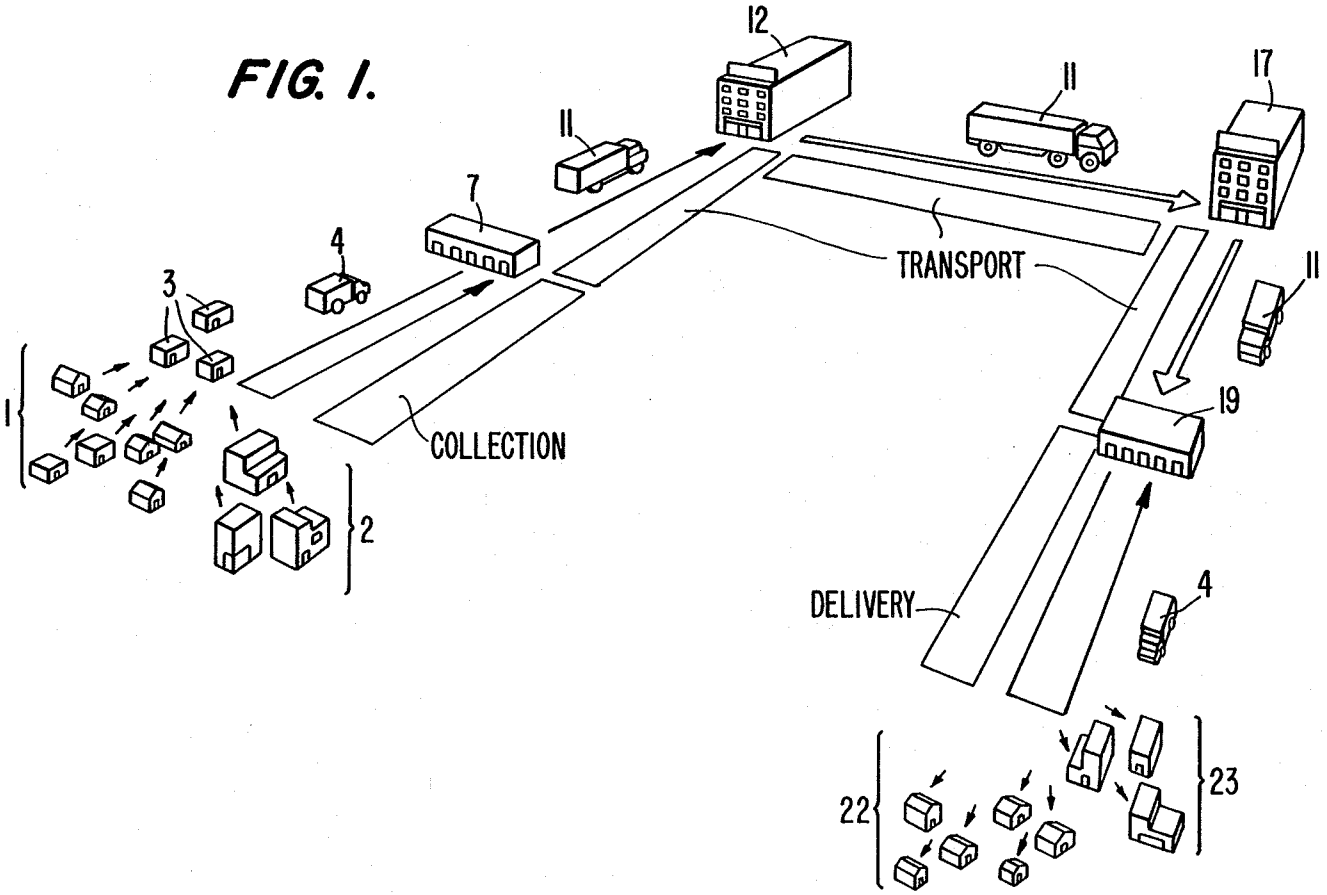
FIG. 1 is a diagrammatic view illustrating a transportation system of the type in which a container in accordance with this invention is adapted to be used.
Figure 2:
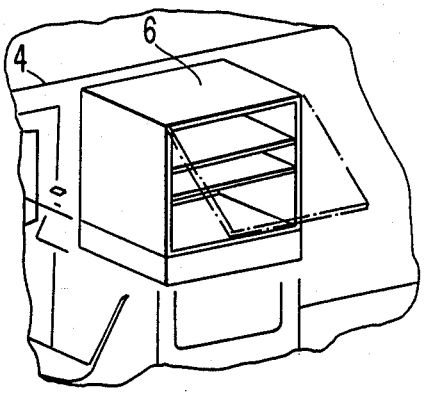
FIG. 2 is a fragmentary view in perspective of a refrigerating apparatus for vehicles of a type used for the pick up and delivery of the packages in the transportation system of FIG. 1.

Referring to FIG. 1, there is shown a transportation system in accordance with this invention. In this system, merchandise which has been gathered at local shops 3 from homes 1 and offices 2 and which includes refrigerated/frozen merchandise that must be maintained under refrigeration temperatures, are loaded onto a truck 4 for transporting them to an intermediate station 7. The truck 4 is provided with a refrigerated box 6, as shown in FIG. 2, for storing the refrigerated/frozen merchandise, which box 6 has a refrigerating apparatus for refrigerating the same that is operated by the engine of the truck 4.

Figure 3:
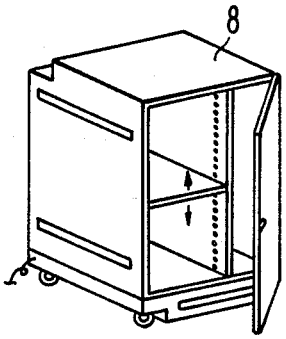
FIGS. 3 and 4 are perspective views of two different types of refrigerated containers adapted for use in the transportation system of FIG. 1.
Figure 4:
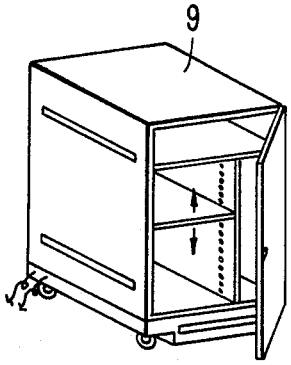

At the intermediate station 7, the refrigerated/frozen merchandise is reloaded into a container such as the container 8 or 9 as shown in FIGS. 3 and 4 from the refrigerated box 6 of the truck 4. The containers 8 and 9 are provided with a refrigerating unit (FIG. 8) which is operated by commercial electric power for refrigerating the interior space thereof while the containers remain at the intermediate station 7. The other parcels and packages are then loaded along with the refrigerated containers 8 or 9 onto the truck 11.

The truck 11 is provided with a second refrigerating unit 13, and one type of container, as shown in FIG. 3, is designed to be connected with the second refrigerating unit 13 to continue the refrigerating operation within the interior space of the container. Alternatively, as shown in FIG. 4 the container may be provided with a cold storage media that will cool the interior space of the container while it is being carried on the truck 11.

The containers 8 or 9 are gathered at the base station 12 from several intermediate stations 7. At the base station 12, the containers are unloaded and sorted in accordance with their destination. While remaining at the base station 12 the refrigerated containers 8 or 9 are refrigerated by the built-in refrigerating apparatus that is run by commercial electric power.

The sorted containers are then loaded onto another truck 11 for transporting them to a base station 17 from which they are to be distributed. While being transported by the truck 11 the refrigerated containers 8 or 9 are again refrigerated in the same manner as explained above in connection with the transport from the intermediate station 7 at which they are gathered to the base station 12. Upon arriving at the base station 17, the containers are loaded onto another transporting truck 11 to deliver them to an intermediate station 19. The merchandise, parcels and packages are then reloaded onto a truck 4 with the refrigerated/frozen merchandise being transferred from the containers 8 or 9 to the refrigerating box 6 of the truck 4. The merchandise, parcels and packages are then delivered by the truck 11 to the designated homes 22 or offices 23, respectively.

Figure 7:
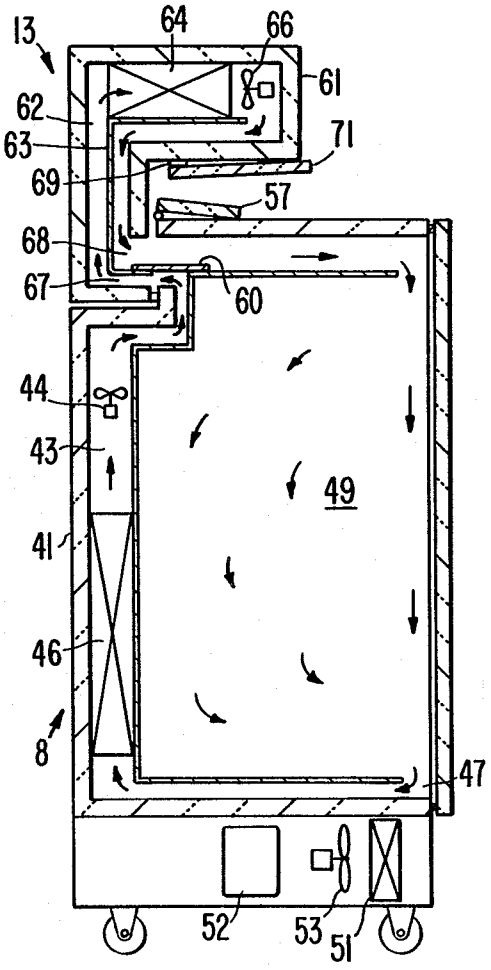
FIG. 7 is a cross sectional view of the container of FIG. 6 as it is used on a truck.
Figure 6:
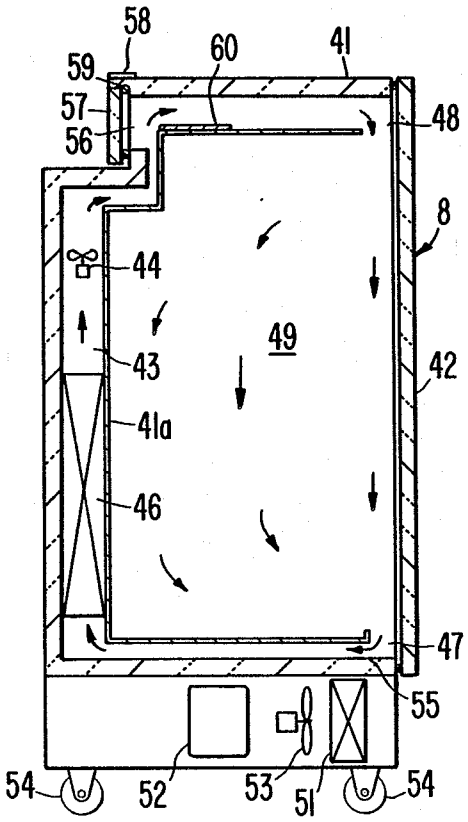
FIG. 6 is a cross sectional view of the container of FIG. 3 as it is used in a warehouse or similar facility.

Referring to FIGS. 6 and 7, there is shown one type of refrigerating container 8 and second refrigerating unit 13 which are utilized in the above-explained transporting system. Container 8 comprises an interior space 49 with a plurality of insulated wall panels 41 defining a compartment that is closed except for the front opening which is closed by a hinged door 42 to permit loading and unloading the merchandise.

An air passageway 43 is defined in the interior space 49 along the inner surface of the bottom, rear and top panels 41 by a separating plate 41*a* spaced from the panels 41. An evaporator 46 and a fan 44 are disposed in the passageway 43, the evaporator 46 acting to cool the air circulated therethrough by the fan 44. The air intake opening 47 and an air discharge opening 48 of passageway 43 are open into the interior space 49 of the container 8 adjacent to the door 42 at the bottom and top thereof respectively. Air in the interior space 49 is forced to circulate by operation of the fan 44 and is refrigerated by the evaporator 46.

The evaporator 46 is interconnected with a compressor 52 and condenser 51 both of which are disposed in a mechanical chamber defined in the lower portion of the container 8 beneath the bottom panel 41 and comprises the refrigerating unit for the container 8. A fan 53 is disposed in the mechanical chamber for circulating air over the compressor and condenser. Compressor 52 and fan 53 are operated by commercial electric power and may be controlled by a signal from a thermistor 55. The interior space 49 of the container is thus refrigerated.

Figure 8:
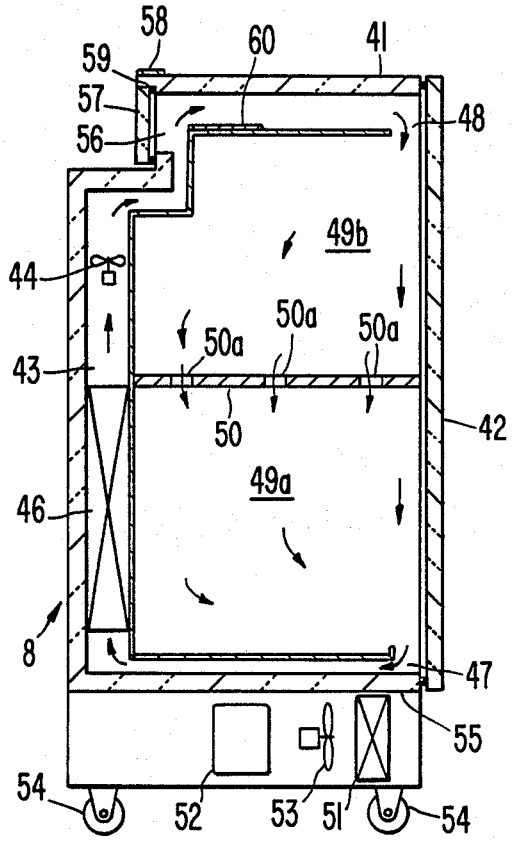
FIG. 8 is a cross sectional view of a container which is modified from the container of FIG. 6.

As shown in FIG. 8, a shelf 50 with a plurality of holes 50*a* may be disposed in the interior space 49 to horizontally divide the space 49 into two spaces 49*a*, 49*b*, and thus provide for different types of refrigerated/frozen merchandise to be stored under different temperatures in the same container. Because the upper space 49*b* is open to the air discharge opening 48 from which the refrigerated air is discharged, the upper space 49*b* can be maintained at a lower temperature than lower space 49*a*. The air circulation within the interior space 49 of the container is ensured by the holes 50*a* in the shelf 50.

As seen in FIG. 6, a connecting opening 56 is formed at the rear and upper end of the container 8 opening into the passageway 43. This connecting opening 56 is normally closed by the hinged door 57. The contact surface between the door 57 and the opening 56 is sealed by seal 59. A damper in the form of a slidable plate 60 is disposed on the upper part of the separator plate 41*a* at the top adjacent to the opening 56 — the separator plate 41*a* being arranged so that it is substantially at the elevation of the midpoint of the opening 56 so that when the plate 60 is slid rearwardly as shown in FIG. 7, it horizontally bisects the opening 56 at its vertical midpoint. Also, wheels 54 may be attached on the lower surface of the container 8 so that the container 8 can be easily moved about.

Figure 5:
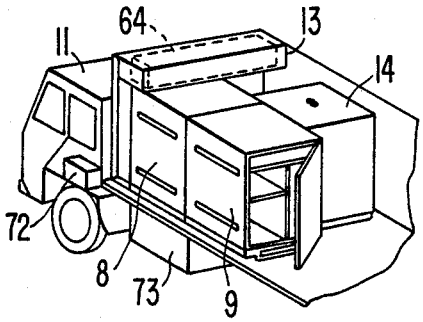
FIG. 5 is a fragmentary perspective view illustrating the use of the containers of FIGS. 3 or 4 on a vehicle.

The second refrigerating unit 13, which is disposed on the truck 11 as shown in FIG. 5, includes a casing 61 that is inverted L-shaped in cross section, and an evaporator 64 and a fan 66. Casing 61 is formed with an opening at the lower portion thereof which is normally closed by a door 71 on a hinge 69 that is adapted to be swung along with the door 57 into the space under the forwardly extending portion of the casing 61 when the container 8 is connected to the second refrigerating unit 13. The inner space of casing 61 is also divided by a partition plate 63 into a one-way air passage 62, the air being introduced into the passage 62 from an intake opening 67 and discharged therefrom through an outlet opening 68 after having passed through the interior space of the casing 61. The evaporator 64 and fan 66 are disposed midway along the passage 62 so that the air introduced into the passage 62 due to the operation of the fan 66 is cooled and discharged into the internal space 49. In this embodiment, evaporator 64 is connected with a compressor 72 (FIG. 5) which is driven by the engine of the truck 11 and a condenser 73 disposed in the lower portion of the truck 11.

When the container 8 is carried on the truck 11 it is connected to the second refrigerating unit 13. That is, the opening 56 of the container 8 is connected to the openings 67 and 68 of the second refrigerating unit 13, as shown in FIG. 7. In this condition, the movable plate 60 is slid into contact with the partition wall 63 of the second refrigerating unit 13, thus connecting the air passageway 43 to the passage 62 through the opening 67 of the refrigerating unit 13 to define a one-way passage for air through the opening 68 into the interior space on compartment 49. The compartment 49 of the container 8 is thus refrigerated by the second refrigerating unit 13, while it is being carried on truck 11.

Figure 9:
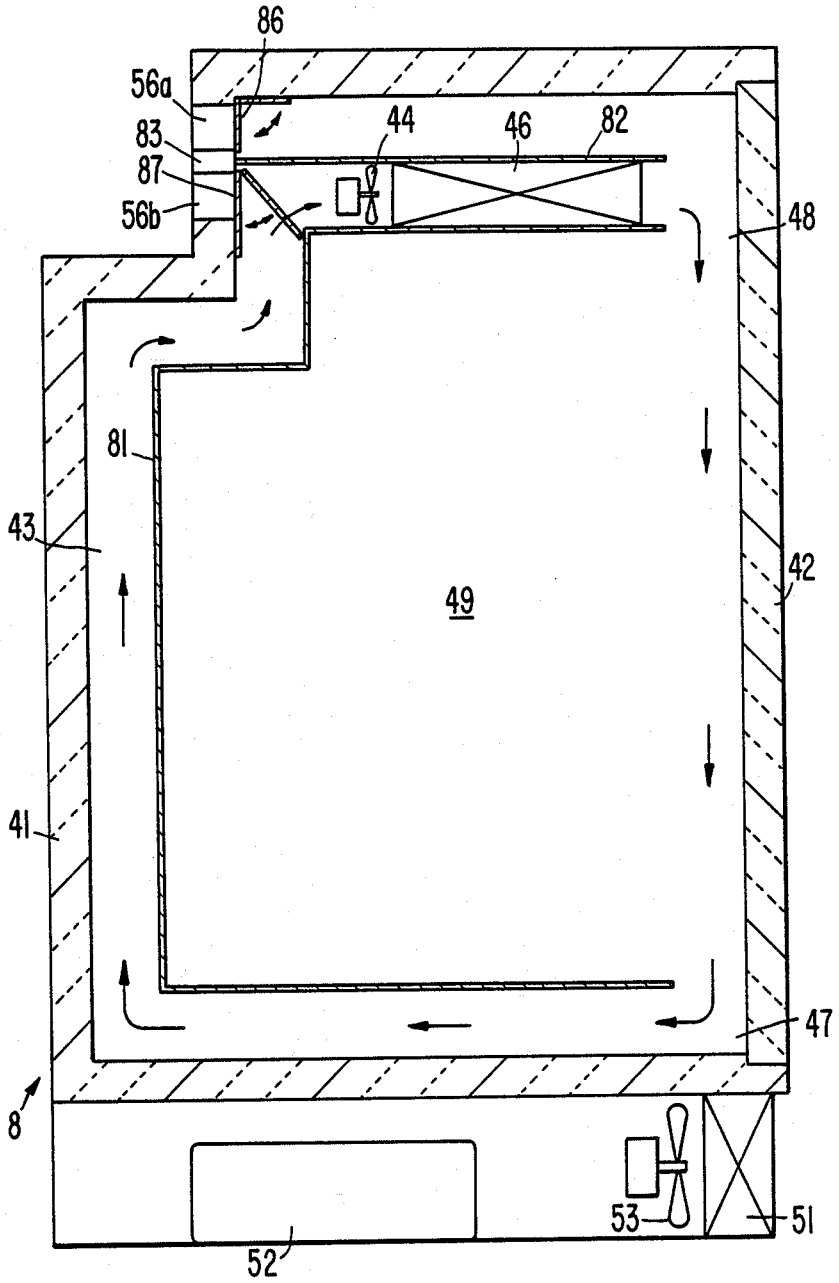
FIG. 9 is a cross sectional view of a container in accordance with still another embodiment of this invention as it is used in a warehouse or similar facility.
Figure 10:
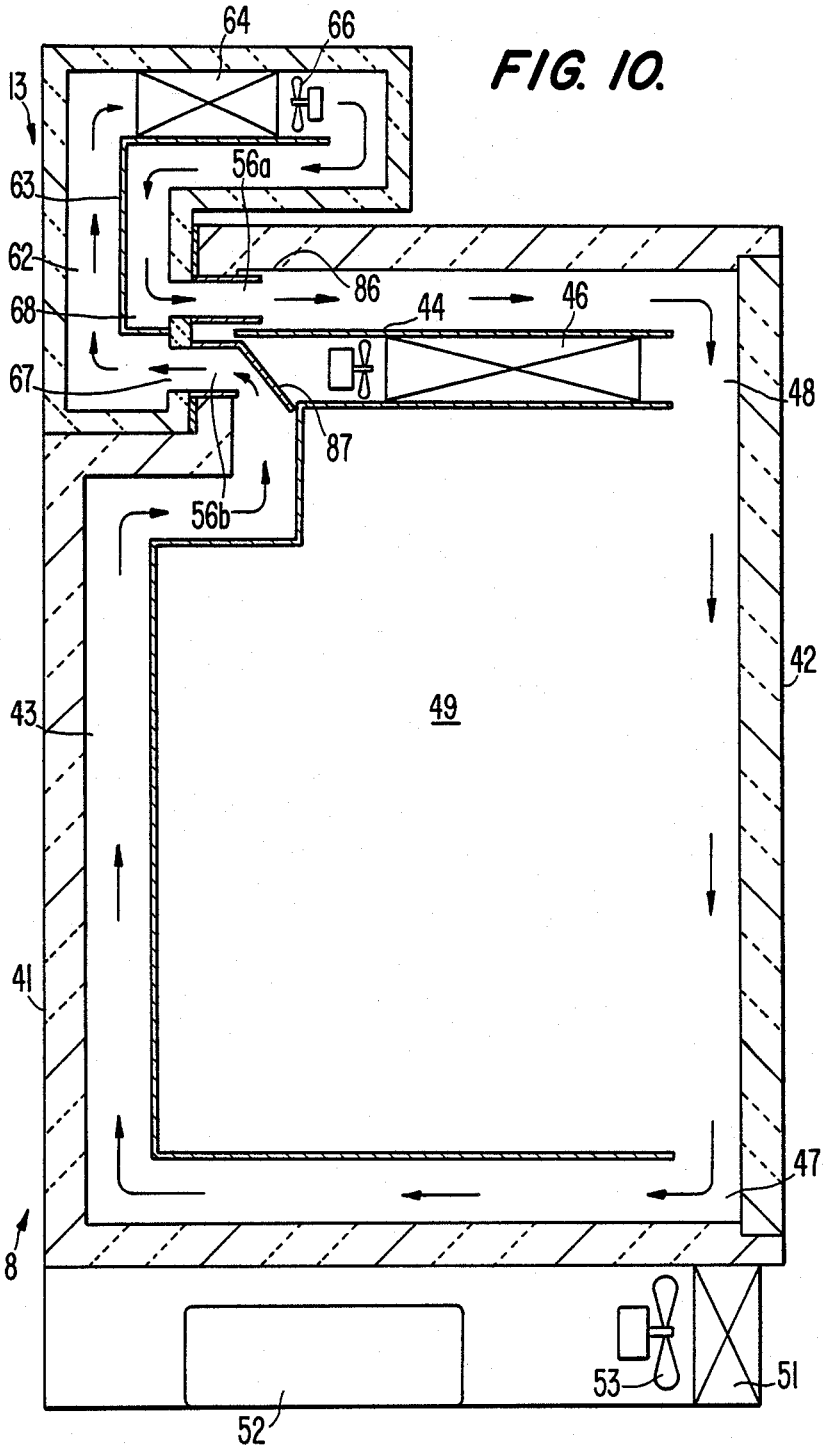
FIG. 10 is a cross sectional view of the container of FIG. 9 as it is used on a truck.

In the embodiment shown in FIG. 6, the evaporator 46 of the refrigerating unit is positioned at the back wall of the container 8. Alternatively, the evaporator 46 may be disposed adjacent the top wall of the compartment 49 on partition plate 81 as shown in FIG. 9. That is, as shown in FIGS. 9 and 10, the evaporator 46 is disposed at the upper portion of the compartment 49 and the air passageway with the second refrigerating unit 13 is defined by a separating plate 82 extending forwardly from the partition 83 between two holes 56*a* and 56*b* that together comprise the opening 56, each of the holes 56*a* and 56*b* being normally closed by a damper element 86, 87, respectively.

Figure 11:
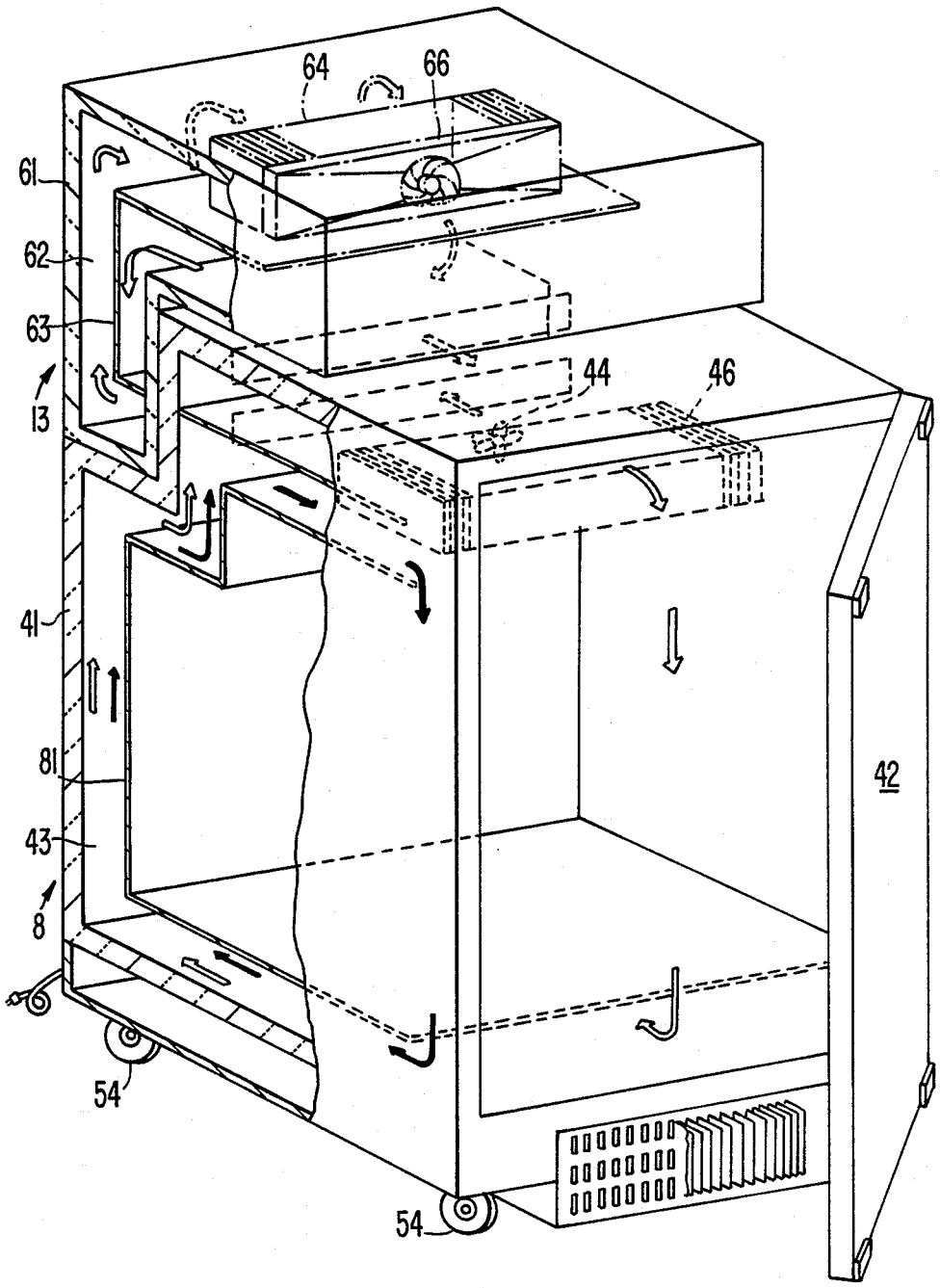
FIG. 11 is a perspective view of the container of FIG. 10 illustrating the flow of air.

In operation, the container 8 is placed on commercial electric power when in the intermediate or base stations, and the openings 56*a* and 56*b* are closed by the damper element 86, 87. Air in the container 8 is thus forced to circulate by the fan 44 and pass through the evaporator 46 (the flow direction of the air is indicated by the solid arrow in FIG. 11) to refrigerate the compartment 49 of the container 8.

On the other hand, when the container 8 is carried on the truck 11, the container is interconnected with the second refrigerating unit 13. That is, the one damper element 87 is opened to connect the opening **56*b* into the inlet opening 67 and to close the way to the evaporator 46. The other damper element 86 is opened to connect the opening 56*a* to the outlet opening 68. Thus, air from the passageway 43 communicates with the second refrigerating unit 13 and forced circulation of air is caused by operation of the fan 66. The air is thus passed through the evaporator 64 of the second refrigerating unit 13 and is returned to the compartment 49 (the air flow way being indicated by the outline arrows in FIG. 11) to thereby continue the refrigeration of the compartment 49**.

Figure 12:
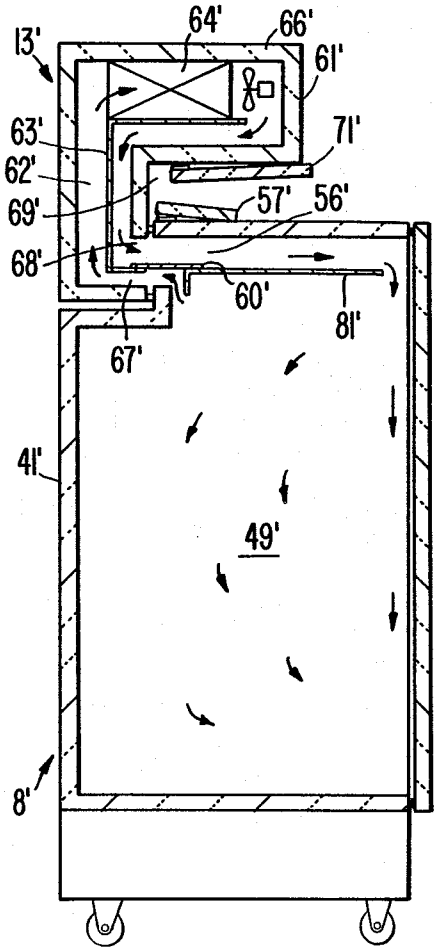
FIG. 12 is a cross sectional view of a container in accordance with another embodiment of this invention as it is used in a warehouse or similar facility.

In the above embodiments, the container 8 is provided with refrigerating apparatus for refrigerating the compartment 49 of the container itself while it remains in a base or other facility. However, if a refrigerating apparatus 13' (FIG. 12) which may be substantially the same as the second refrigerating unit 13 of the truck 11, is set up at each of the bases, the refrigerating unit for container 8 can be eliminated. That is, as shown in FIG. 12, container 8' comprises an compartment 49' defined by insulation panels 41' and is provided with a connecting opening 56' which is closed by a hinged door 57'. A separating plate 81' and a movable plate 60' cooperate with the partition plate 63' of the refrigerating unit 13' to define the air passageway. Therefore, while the container 8' is connected with the refrigerating unit 13' the compartment 49' is continuously refrigerated in the same manner as explained with reference to FIG. 7.

Figure 13:
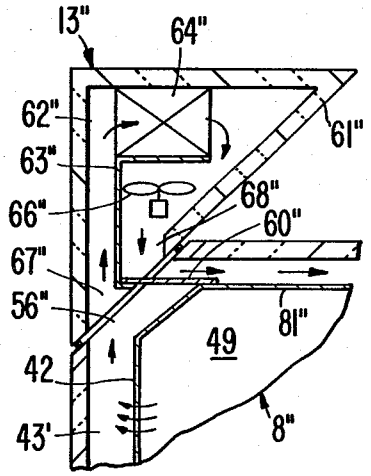
FIG. 13 is a fragmentary cross sectional view illustrating the second refrigerating unit in accordance with another embodiment of this invention.

The connecting structure between the container 8' and the refrigerating unit 13' may be modified as shown in FIG. 13. That is, container 8'' has an air passageway 43' defined by a separation plate 42 and forming a connecting opening 56'' at the rear corner thereof that communicates with an opening 67'', 68'' of the refrigerating unit 13''. The air passageways to circulate air through the evaporator 64'' are defined by the separation plate 81'', the movable plate 60'' and the partition plate 63''.

This invention has been described in detail in connection with preferred embodiments but there are for example only and the invention is not restricted thereto. It will be readily understood by those skilled in the art that other variations and modifications can be made within the scope of this invention.

We claim:

1. A refrigerated container for transporting refrigerated or frozen merchandise comprising:

A closed compartment including:

insulated walls; and a door;

refrigerating apparatus including a compressor and a condenser mounted on the container exteriorly of said compartment;

means for defining an air path within said compartment, having an intake end and an outlet end relative to said compartment;

an evaporator disposed within said compartment and mounted in said air path;

fan means for circulating air in said path through said evaporator;

a source of refrigerated air external to said compartment;

aperture means extending through said insulated walls and intersecting said air path defining means for introducing refrigerated air into said compartment from said external refrigerated air source to the compartment and for returning air to said external refrigerated air source; and means for closing said aperture means when said compressor is operated and for opening said aperture means to connect the same to an external source of refrigerated air when said compressor is not operated; and in which said external refrigerated air source further comprises:

a secondary refrigerating unit having a secondary air path with intake and outlet means for connection to said aperture means;

a secondary evaporator disposed in said secondary air path; and means for moving air through said secondary air path through said evaporator and through said aperture means into and from said compartment when said inlet and outlet means are connected to said aperture means and said compressor is not operated.

2. A refrigerated container for transporting refrigerated or frozen merchandise comprising:

a closed compartment including:

insulated walls having aperture means extending through said walls for defining an air inlet and an air outlet for said compartment; and a door;

refrigerating means, external to said container, for introducing refrigerated air into said compartment and for returning air from said compartment, including a secondary evaporator and having openings for communicating with said air inlet and air outlet;

means for defining an air path connecting said openings;

an evaporator disposed in said air path;

means for circulating air from said compartment through said air outlet into said air path and through said air path disposed evaporator and said air inlet back to said compartment; and means for closing said air inlet and air outlet when said refrigerating means is separated from said container.

3. A refrigerated container as in claim 2, wherein said air path defining means provides an air path within said compartment; and said aperture means opens into said compartment, whereby said air inlet and said air outlet are connected to spaced points within said compartment.

4. A refrigerated container as in claim 2, further comprising a compressor and a condenser disposed external to the compartment and interconnected with said air path disposed evaporator.

5. A refrigerated container as in claim 4, further comprising a chamber disposed below a bottom portion of said compartment which houses said compressor and said condenser.

6. A refrigerated container as in claim 4, wherein said compressor can be operated by commercial electric power.

7. A refrigerated container for transporting refrigerated or frozen merchandise comprising:

a closed compartment including:

insulated walls; and a door;

refrigerating apparatus including a compressor and a condenser mounted on the container exteriorly of said compartment;

means for defining an air path within said compartment, having an intake end and an outlet end relative to said compartment;

an evaporator disposed within said compartment and mounted in said air path;

fan means for circulating air in said air path through said evaporator;

a source of refrigerated air external to said compartment;

aperture means extending through said insulated walls and intersecting said air path defining means for introducing refrigerated air into said compartment from said external refrigerated air source and for returning air to said external refrigerated air source; and means for closing said aperture means when said compressor is operated and for opening said aperture means to connect the same to an external source of refrigerated air when said compressor is not operated.

8. A refrigerated container in accordance with claim 7 in which said aperture means further comprises damper means for interrupting said air path and for connecting said aperture means into said air path.

9. A refrigerated compressor as in claim 7, wherein said source of external refrigerated air further comprises a secondary evaporator and a fan.

10. A refrigerated container as in claim 9, wherein said secondary evaporator of said source of refrigerated air can be connected with a secondary compressor, external to said compartment, which can be driven by an engine of a truck.

11. A refrigerated container as in claim 7, wherein said source of refrigerated air further comprises a surrounding casing which has an inverted L-shaped cross-section with openings disposed against said aperture means at a lower portion of said casing.

* * * * *